US011871816B2

(12) United States Patent
Baschak et al.

(10) Patent No.: US 11,871,816 B2
(45) **Date of Patent: *Jan. 16, 2024**

(54) RELEASABLE FASTENER

(71) Applicant: NIKE, Inc., Beaverton, OR (US)

(72) Inventors: Kimberly D. Baschak, Portland, OR (US); Kyle Schepke, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 215 days.

This patent is subject to a terminal disclaimer.

(21) Appl. No.: 17/372,644

(22) Filed: Jul. 12, 2021

(65) Prior Publication Data

US 2021/0337939 A1 Nov. 4, 2021

Related U.S. Application Data

(63) Continuation of application No. 16/449,891, filed on Jun. 24, 2019, now Pat. No. 11,058,187.

(60) Provisional application No. 62/700,316, filed on Jul. 18, 2018.

(51) Int. Cl.
*A44B 19/14* (2006.01)

(52) U.S. Cl.
CPC ..... *A44B 19/14* (2013.01)

(58) Field of Classification Search
CPC ..... A44B 19/14; A41F 1/00
See application file for complete search history.

(56) References Cited

U.S. PATENT DOCUMENTS

| | | | |
|---|---|---|---|
| 2,841,850 | A | 7/1958 | Zahorski |
| 3,050,842 | A | 8/1962 | Herbert |
| 3,176,364 | A | 4/1965 | Arthur |
| 3,196,196 | A | 7/1965 | Burbank |
| 3,263,292 | A | 8/1966 | Fekete |
| 4,947,525 | A | 8/1990 | Van |
| 5,390,396 | A | 2/1995 | Hirota |
| 5,553,323 | A | 9/1996 | Chou et al. |
| 5,564,126 | A | 10/1996 | Chou |
| 5,572,742 | A | 11/1996 | Mcfadden |
| 5,727,255 | A | 3/1998 | Minks |
| 6,119,270 | A | 9/2000 | Chou |
| 6,216,270 | B1 | 4/2001 | Moquin et al. |
| 6,260,200 | B1 | 7/2001 | Alfred |
| 6,675,389 | B1 | 1/2004 | Kublick |
| D520,213 | S | 5/2006 | Dureus |
| 7,171,730 | B2 | 2/2007 | Kasai |

(Continued)

FOREIGN PATENT DOCUMENTS

| | | | |
|---|---|---|---|
| CN | 202566395 | U | 12/2012 |
| DE | 19721225 | A1 | 11/1998 |

(Continued)

OTHER PUBLICATIONS

Office Action received for European Patent Application No. 19746222.9, dated Dec. 8, 2021, 7 pages.

(Continued)

*Primary Examiner* — David M Upchurch

(74) *Attorney, Agent, or Firm* — SHOOK, HARDY & BACON L.L.P.

(57) ABSTRACT

This disclosure describes a releasable fastener having two portions that slide together to affix two portions of an article. For example, the two portions may include an elongated rail that slides into an elongated slot or tube.

20 Claims, 5 Drawing Sheets

(56) References Cited

U.S. PATENT DOCUMENTS

| | | | | |
|---|---|---|---|---|
| 7,308,738 | B2 * | 12/2007 | Barvosa-Carter | F16B 5/07 24/442 |
| 7,316,101 | B1 * | 1/2008 | Nguyen | B65B 31/06 53/434 |
| 7,934,269 | B1 | 5/2011 | Lask et al. | |
| 8,161,573 | B1 | 4/2012 | Burns-Cox | |
| 8,302,268 | B2 | 11/2012 | Kasai | |
| 8,469,593 | B2 * | 6/2013 | Price | B65D 33/2558 24/585.12 |
| 8,875,356 | B2 * | 11/2014 | Zerfas | A44B 18/008 24/304 |
| D733,400 | S | 7/2015 | Cunningham | |
| 9,260,225 | B2 * | 2/2016 | Anzini | B65D 33/2558 |
| 9,380,816 | B2 | 7/2016 | Jo Longfellow | |
| 9,930,938 | B2 * | 4/2018 | Van Pelt | A44B 17/0023 |
| 2004/0143880 | A1 | 7/2004 | Clark et al. | |
| 2004/0255357 | A1 | 12/2004 | Erickson | |
| 2011/0296586 | A1 | 12/2011 | Jaros | |
| 2012/0106876 | A1 | 5/2012 | Pawloski | |
| 2012/0222190 | A1 | 9/2012 | Lambertz | |
| 2014/0026289 | A1 | 1/2014 | Schulties | |
| 2015/0020288 | A1 | 1/2015 | Picot | |
| 2016/0286872 | A1 | 10/2016 | Wilson | |
| 2016/0316832 | A1 | 11/2016 | Straughan | |
| 2016/0366957 | A1 | 12/2016 | Chen Tsai | |
| 2017/0099886 | A1 | 4/2017 | Mahoney | |
| 2017/0311653 | A1 | 11/2017 | Zwickel | |
| 2019/0261702 | A1 | 8/2019 | Mchugh | |
| 2020/0022465 | A1 | 1/2020 | Baschak et al. | |

FOREIGN PATENT DOCUMENTS

| | | | |
|---|---|---|---|
| DE | 20319298 | U1 | 2/2004 |
| DE | 102013109704 | A1 | 3/2015 |
| EP | 1618805 | B1 | 1/2009 |
| FR | 2745155 | A1 | 8/1997 |
| GB | 944583 | A | 12/1963 |
| JP | 3965374 | B2 | 6/2007 |
| RU | 2462965 | C1 | 10/2012 |
| RU | 172880 | U1 | 7/2017 |
| WO | 2012/034561 | A2 | 3/2012 |

OTHER PUBLICATIONS

Girls' Adaptive Puffer Jackel—Cat & Jack™ Purple, Cat & Jack, target.com, TCIN: 52670242, Store Item No. DPCI): 048-05-0106, Available online at: <https://www.largel.com/p/girls-adaptive-puffer-jackel-cal-jack-153-purple/-/A-52782097>, Nov. 2017.

Janska Fleece Easy Wear Jacket Red, Janska, caregiverproducts.com, Part No. CJW500R, Available online at: <https://web.archive.org/web/20170630103009/hllp://www .caregiverproducts.com/janska-fleece-easy-wear-jacket-red.html>, Jun. 30, 2017, 4 pages.

Koolkoat—Spring/Summer, Koolway Sports, koolwaysports.com, Available online at: <https://web.archive.org/web/20171122012723/hllp://koolwaysports.com/producl/summer-jacket/>, Nov. 22, 2017, 10 pages.

Para quern tern necessidades especiais? Roupas especiais, EcoD, ecodesenvolvimento.org, Available online at: <http:/lwww.ecodesenvolvimenlo.org/nolicias/para-quern-lem-necessidadesespeciais-roupas>, 4 pages.

The Celine Jacket, Reboundwear, reboundwear.com, Available online at: <https://www.reboundwear.com/collections/womens-lops/products/lhe-celine-brushed-lining>, Nov. 22, 2017, 4 pages.

Frarrier, John, "Clothes Designed Specifically for Wheelchair Users", Neatorama, neatorama.com, Available online at: <http://www.neatorama.com/2016/02/24/Clolhes-Designed-Specifically-for-Wheelchair-Users/>, Feb. 24, 2016.

Office action received for European Patent Application No. 19746222.9, dated Aug. 9, 2022, 5 pages.

Intention to Grant received for European Patent Application No. 19746222.9, dated Jul. 18, 2023, 7 pages.

* cited by examiner

RELEASABLE FASTENER

CROSS-REFERENCE TO RELATED APPLICATIONS

This application is a continuation of U.S. patent application Ser. No. 16/449,891, filed Jun. 24, 2019 and entitled "Releasable Fastener" which claims the benefit of priority of U.S. Prov. App. No. 62/700,316, filed Jul. 18, 2018, and entitled "Releasable Fastener." The entirety of the aforementioned applications are incorporated by reference herein.

TECHNICAL FIELD

This disclosure relates to a releasable fastener having two portions that slidably engage to connect portions of an article.

BACKGROUND

Various types of releasable fasteners may be used to connect portions of an article together. One type includes a first portion (e.g., rail) that slidably inserts into a second, tubular portion (e.g., slot). Sometimes, it may be challenging to insert the first portion into the second portion. In addition, the first portion may sometimes unintentionally disengage from the second portion.

BRIEF DESCRIPTION OF THE DRAWINGS

Subject matter is described in detail in this Specification with reference to the below listed figures, which are incorporated herein by reference.

DETAILED DESCRIPTION

Figure 1A:
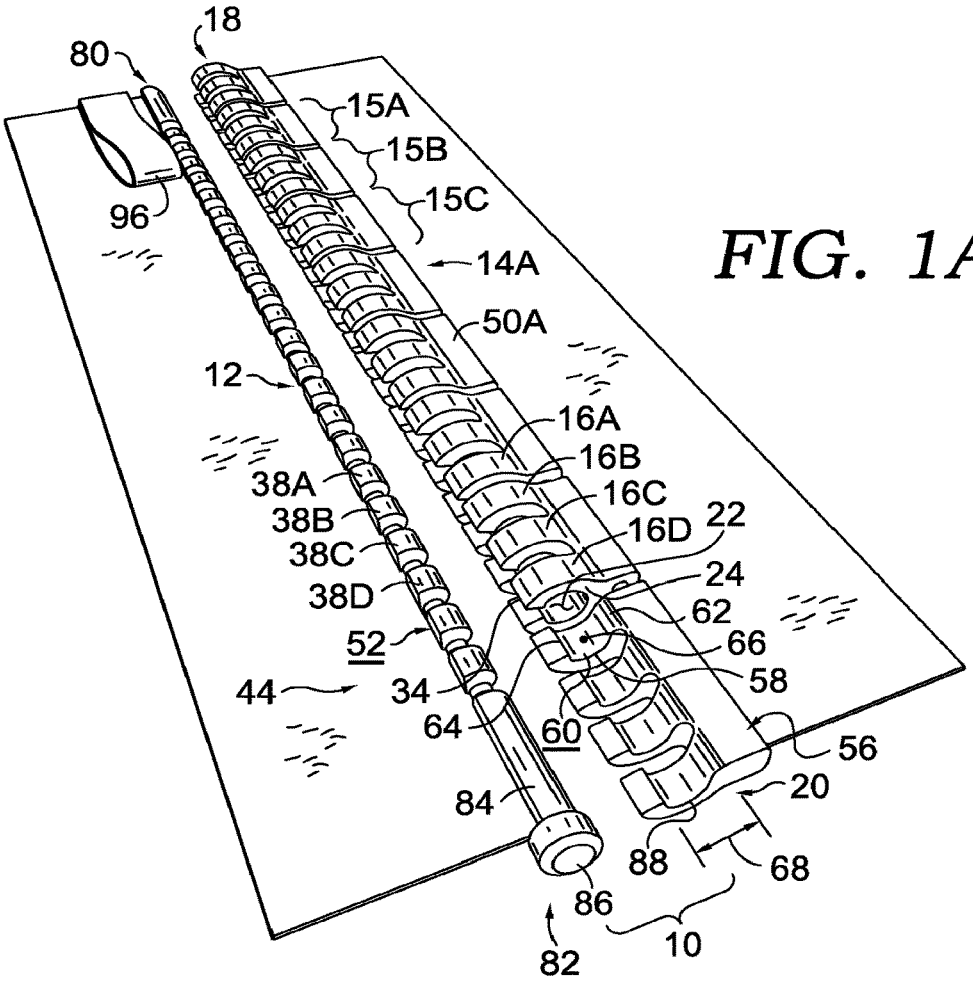
FIGS. 1A and 1B depict a first example fastener, in accordance with an aspect of this disclosure.

Subject matter is described throughout this Specification in detail and with specificity in order to meet statutory requirements. But the aspects described throughout this Specification are intended to be illustrative rather than restrictive, and the description itself is not intended necessarily to limit the scope of the disclosure or the claims. Rather, the disclosed and claimed subject matter might be practiced in other ways to include different elements or combinations of elements that are similar to the ones described in this Specification and that are in conjunction with other present, or future, technologies. Upon reading the present disclosure, alternative aspects may become apparent to ordinary skilled artisans that practice in areas relevant to the described aspects, without departing from the scope of this disclosure. It will be understood that certain features and subcombinations are of utility and may be employed without reference to other features and subcombinations. This is contemplated by, and is within the scope of, the disclosure and the claims.

At a high level, the disclosure describes a releasable fastener having two portions that slide together to affix two portions of an article. For example, the two portion may include an elongated rail that slides into an elongated slot or tube. For example, FIG. 1A includes a releasable fastener 10 having a first connector 14A and a second connector 12. The first connector 14A is an elongated channel 22 or slot that is formed by a plurality of tubular members. The second connector 12 includes a rail-type structure that slidably inserts into the first connector 14A. The first connector 14A and the second connector 12 are selectively configurable between a connected state (e.g., FIGS. 3 and 5) and a disconnected state (e.g., FIG. 1A. That is, the second connector 12 slidably inserts into the first connector 14A in the connected state.

The first connector 14A includes a plurality of connected tubular bodies 16A-D axially aligned end-to-end. The plurality of connected tubular bodies 16A-D collectively includes a first-connector first end 18 and a first-connector second end 20. The length of the first connector 14A is illustrated merely for example purposes and the first connector 14A may include various lengths made up of different numbers of connected tubular bodies. The axial alignment of the plurality of connected tubular bodies 16A-D constructs a partially enclosed receiving channel 22 configured to slidably receive the second connector 12.

Figure 3:
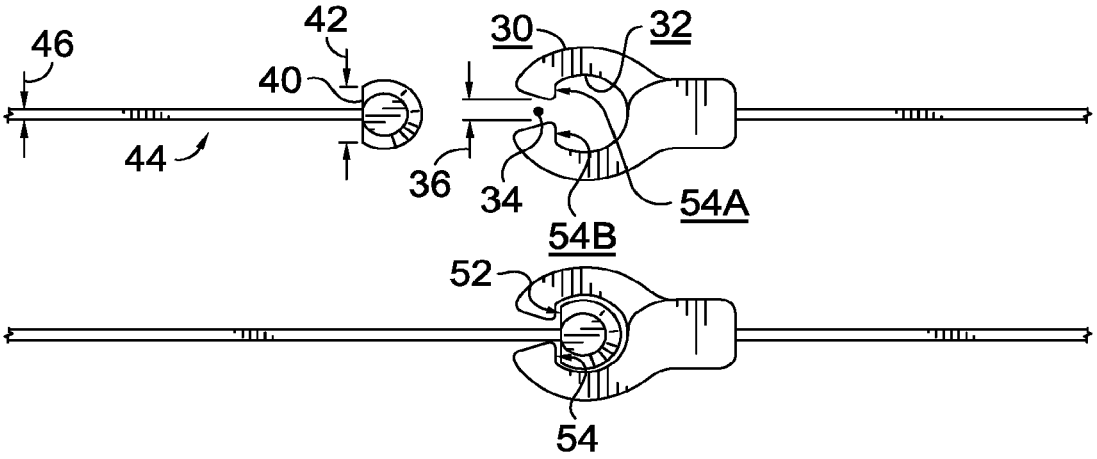
FIG. 3 depicts elevation views of the first example fastener or the second example fastener from an end of the fastener, in accordance with an aspect of this disclosure.

Each tubular body 16A-D includes a tubular wall 24 having a tubular-wall first end 26 (FIG. 1B), a tubular-wall second end 28 (FIG. 1B), an exterior-facing surface 30 (FIG. 1B and FIG. 3), and an interior-facing surface 32 (FIG. 3). In addition, each tubular body 16A-D includes a respective slot 34 (FIG. 1A and FIG. 3) extending entirely from the exterior-facing surface 30 to the interior-facing surface 32 and from tubular-wall first end 26 to the tubular-wall second end 28. Furthermore, each respective slot 34 includes a slot width 36 (FIG. 3) measured from one side of the respective slot to the other side of the respective slot in a radial direction transverse an axis of the tube.

Figure 1B:
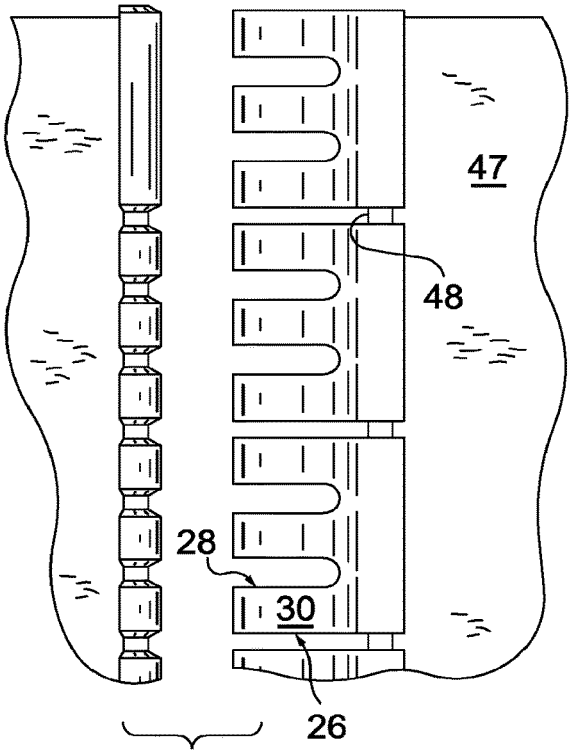
Figure 2A:
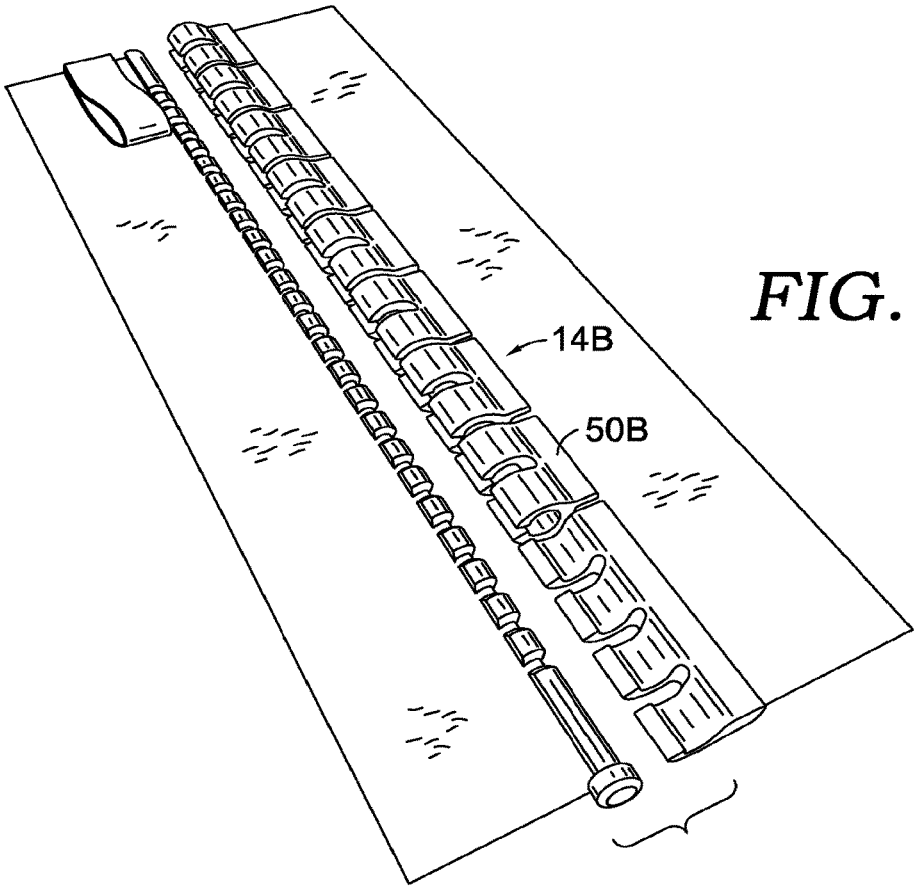
FIGS. 2A and 2B depict a second example fastener, in accordance with an aspect of this disclosure.
Figure 2B:
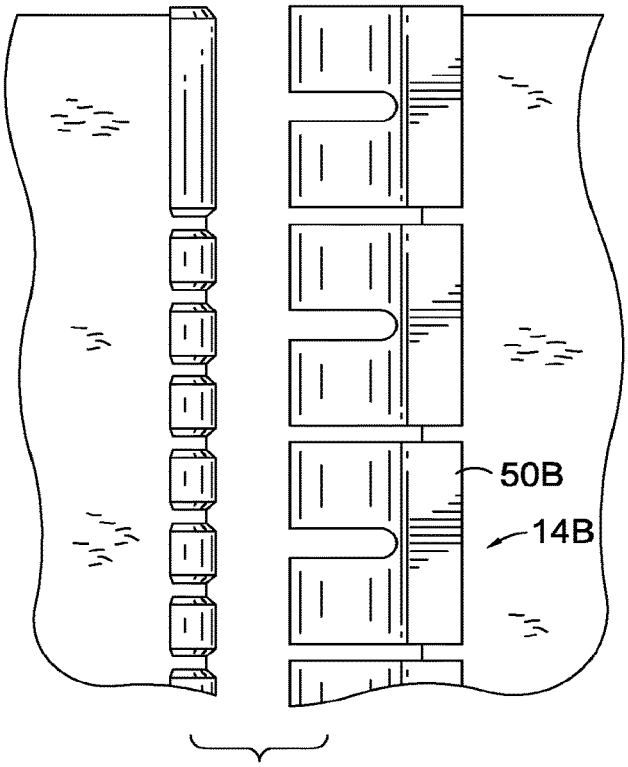

Each of the tubular bodies 16A-D included among the plurality of connected tubular bodies is coupled to an edge 48 of a textile body 47, which connects the connected tubular bodies to each other. Although the edge 48 is identified in FIG. 1B, the aspect depicted in FIG. 2B likewise includes an edge that connects the tubular bodies to each other. In a further aspect, the plurality of connected tubular bodies may include groups of connected tubular bodies such as groups 15A-15C, where each group is connected to a common base, which anchors the respective groups of tubular bodies to the edge 48 of the textile body 47. For example, in FIGS. 1A and 1B, three tubular bodies included among the plurality of connected tubular bodies are connected to the common base 50A. In an alternative aspect depicted in FIGS. 2A and 2B, which depicts a first connector 14B, two tubular bodies included among the plurality of connected tubular bodies are connected to the common base 50B. (Although many of the elements in FIGS. 2A and 2B are not separately described, it is understood that many of the elements described and depicted in FIGS. 1A and 1B are also present, such as the tubular bodies, tubular walls, etc.) Connecting two or more tubular bodies to a common base may provide some additional rigidity and stability to the first connector 14A/B to reduce the likelihood that the first connector 14A/B will unintentionally disengage from (e.g., peel away from) the second connector 12. In other aspects, more than three tubular bodies may share a common base. Alternatively, in different aspects, the tubular bodies may share a common base and/or may each be discretely connected to the edge 48 of the textile body 47. Spacing between tubular bodies may vary in different aspects to adjust flexibility, and in one aspect, the tubular bodies are spaced approximately 0.5 mm apart.

In a further aspect, the second connector 12 includes a plurality of connected insert pins 38A-D axially aligned end to end (also described as an "elongated rail" in this disclosure). Each insert pin includes a respective size and a respective shape configured to slidably move through the first-connector second end 20 and the partially enclosed receiving channel 22. Referring to FIGS. 1A and 3, each insert pin includes a portion 40 having a pin width 42 that is larger than the slot width 36, where the portion 40 is configured to butt against (or abut) the interior-facing surface 32 of the tubular body in the connected state (FIGS. 3 and 5) to impede the insert pin from disengaging through the slot 34. In addition, each insert pin includes an article connector 44 having a connector width 46 that is smaller than the slot width 36 and that extends through the slot 34 in the connected state. Example of article connectors 44 include a textile or fabric tape that may be constructed to include the pins and that may be affixed to a finished article, such as a garment or bag. The pins 38A-D are depicted to include a barrel-type shape (i.e., cylindrical), but the pins may include various other shapes (e.g., spherical) that would allow the pins to slide through the channel 22.

In a further aspect, the portion 40 of the insert pin configured to butt against the interior-facing surface 32 of the tubular body in the connected state includes a pin abutting surface 52 that is substantially flat in a first two-dimensional plane. In addition, the interior-facing surface 32 of the tubular body includes a catch surface 54 that is configured to butt against the pin abutting surface 52 in the connected state and that is substantially flat in a second two-dimensional plane. The article connector 44 extends from the portion 40 of the insert pin, and the respective slot 34 of the tubular body divides the catch surface 54 into a first catch surface 54A and a second catch surface 54B. The pin-abutting surfaces 52 and first and second catch surfaces 54A/B may help to increase horizontal pull strength and impede the second connector 12 from unintentionally being pulled from (i.e., disengaging through) the slot 34 of the first connector 14A.

In an additional aspect, the first connector 14A includes a pin guide 56 coupled to the first-connector second end 20. The pin guide 56 includes a curved pin-guide wall 58 forming a partial tube (i.e., partial relative to the tubes of the tubular bodies 16A-D). The pin-guide wall 58 has a concave surface 60 that is coplanar with a portion of the interior-facing surface 32 of the tubular body, and the concave surface 60 extends from a first edge 62 of the pin-guide wall 58 to a second edge 64 of the pin-guide wall 58. In other words, a mouth 66 of the pin-guide wall 58 extends between the first and second edges 62 and 64. The mouth 66 includes a mouth width 68 measured by a shortest distance between the first edge 62 and the second edge 64, and the mouth width 68 is larger than the pin width 42. As such, the pins 38A-D are sized to insert into, and slidably pass across, the pin guide 56, which directs and guides the pins into the channel 22. Although several of the figures depict a pin guide constructed of a plurality of partial tubes, in another aspect, the pin guide may include a single, elongated, partial tube, having a similar length to the illustrated pin guide 56.

Figure 4A:
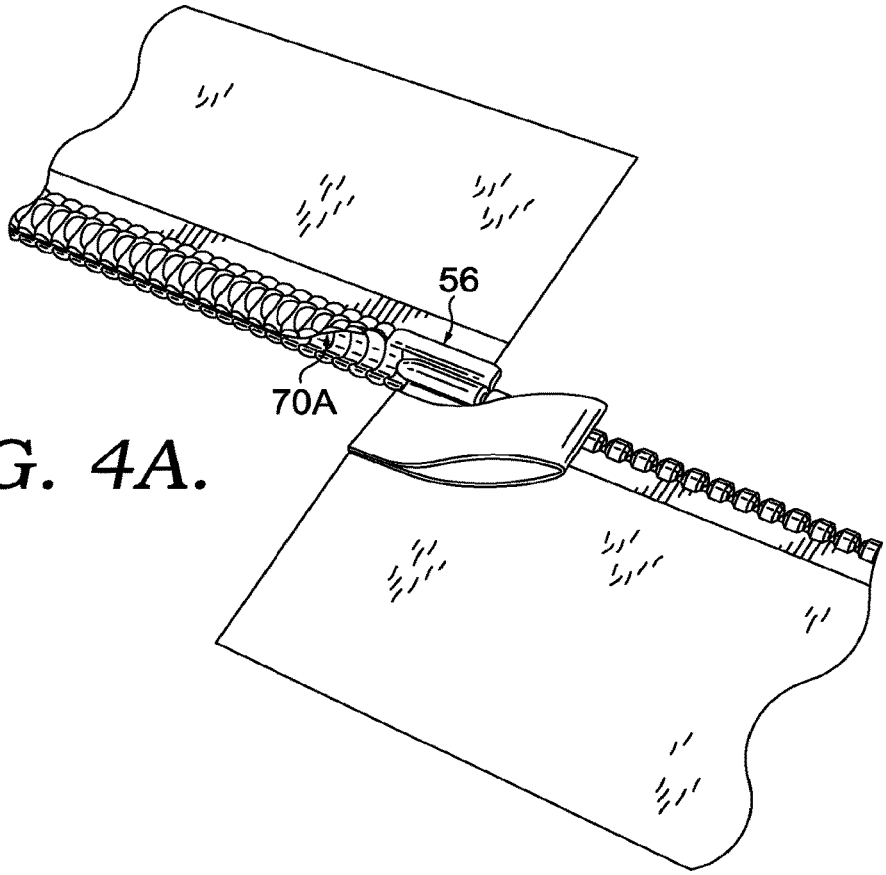
FIGS. 4A and 4B depict example fasteners, each of which illustrates a respective transition area, in accordance with an aspect of this disclosure.
Figure 4B:
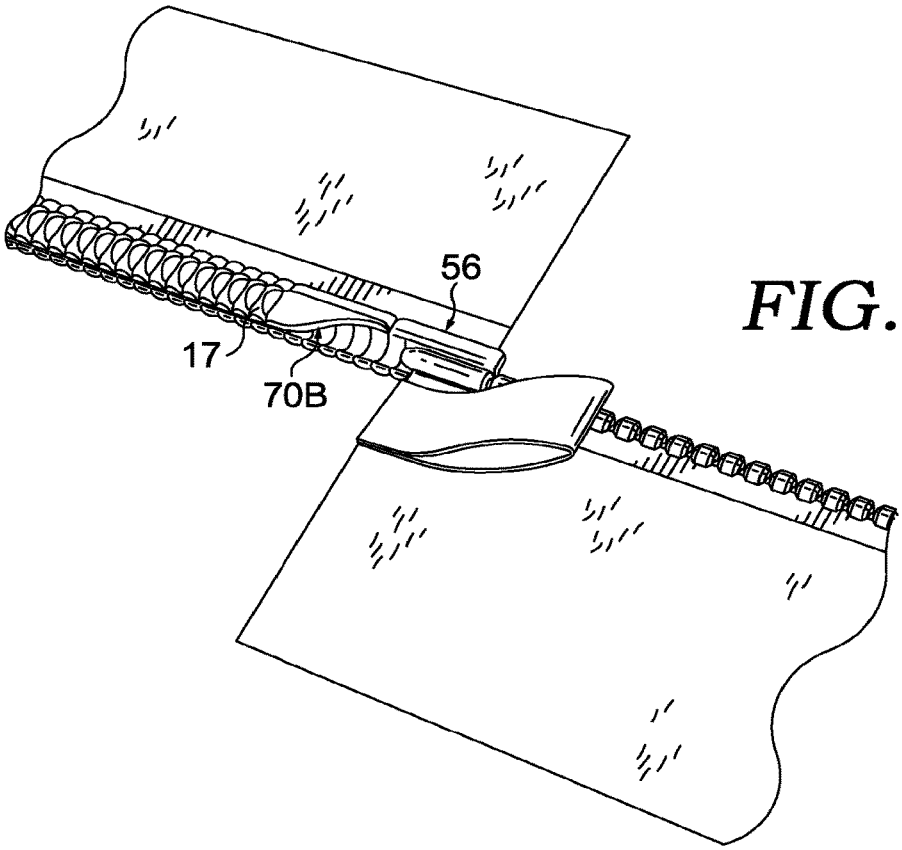

With reference to FIGS. 4A and 4B, in another aspect of the disclosure, the pin guide 56 comprises a tube transition wall 70A/B positioned between the curved pin-guide wall 58 and an initial tubular body 17. The tube transition wall 70A/B includes an interior surface that gradually increases in surface area as the tube transition wall 70A/B extends from the curved pin-guide wall 58 to the initial tubular body 17. In some aspects, the tube transition wall 70A/B includes an "s" shaped or sinuous shaped edge. The tube transition wall 70A/B may operate to facilitate angular insertion of the second connector 12 into the channel 22. That is, as a trailing portion of the second connector 12 is being pulled into the channel 22, the trailing portion may not be perfectly aligned with the axis of the channel 22, and the transition wall with a gradual edge may help to avoid binding or catching that might otherwise sometimes occur with a harder edge or terminal end.

Figure 5:
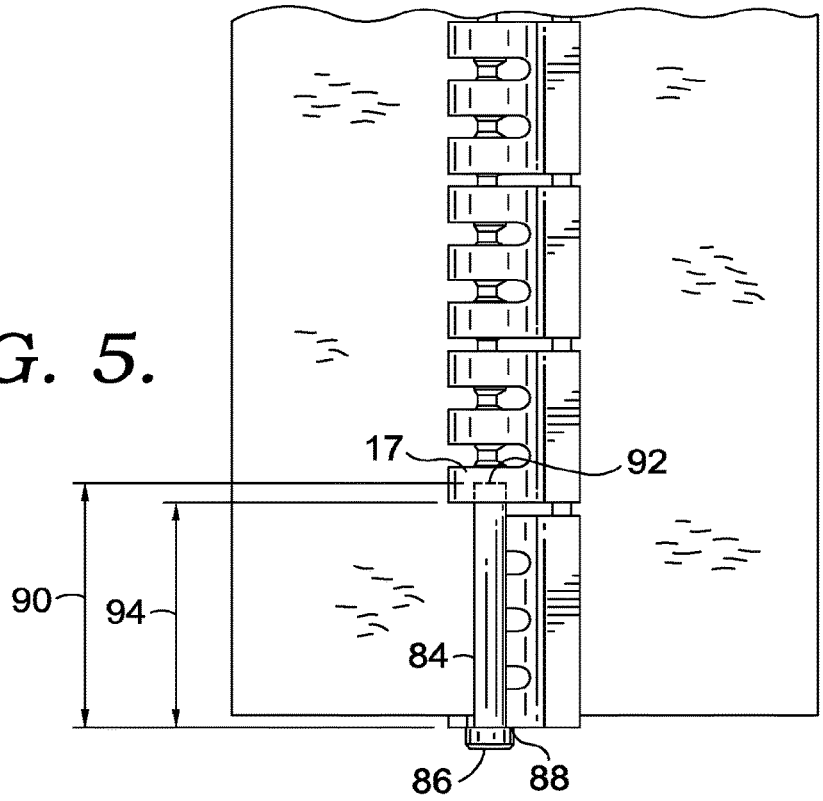
FIG. 5 depicts a fastener in a connected state in which a first portion of the fastener has been slidably inserted into a tubular portion, in accordance with an aspect of this disclosure.

With reference to FIG. 1, the second connector 12 includes a second-connector first end 80, which is inserted into the first-connector second end 20, and the second connector 12 includes a second-connector second end 82 opposite the second-connector first end 80. In an aspect of the disclosure, the second-connector second end 82 includes a stop pin 84 (FIGS. 1 and 5). The stop pin 84 includes an end cap 86 that abuts and engages a terminal end 88 of the first connector 14A/B to impede the second connector 12 from traveling beyond a set length. As depicted in FIG. 5, in accordance with one aspect, the stop pin 84 may include a stop-pin length 90 extending from the end cap 86 to an opposing end 92 of the stop pin 84, and the stop-pin length 90 may be longer than a pin-guide length 94. As such, in one aspect, the opposing end 92 may frictionally engage the initial tubular body 17 to help impede the second connector 12 from inadvertently sliding out from an engaged connection.

Figure 6:
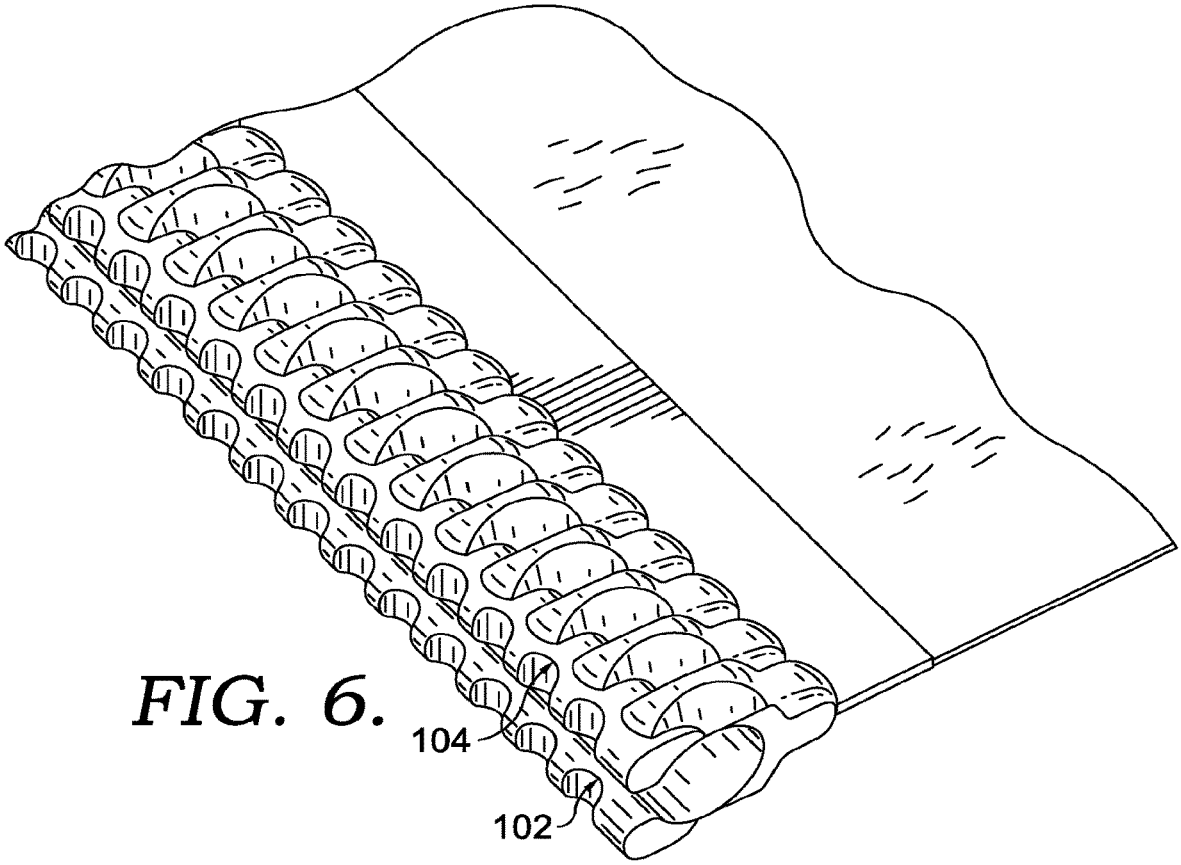
FIG. 6 depicts an alternative configuration in which additional rails are coupled with the tubular portion(s) of the fastener, in accordance with an aspect of this disclosure.

The releasable fastener 10 may include additional elements. For example, in one aspect a pull tab 96 is securely affixed near the second-connector first end 80 to help guide the second connector 12 into the channel 22. In other aspects, as depicted by FIG. 6, rails 102 and 104 may be affixed to the tubular bodies to connect the tubular bodies near the slots. Among other functions, the rails 102 and 104 may help to reduce unintentionally disengagement or derailing between the first and second connectors 14A/B and 12.

The releasable fastener 10 described in this Specification may be used in various articles. For example, the releasable fastener 10 may be used to connect to portions of a garment, footwear, or bag. In addition, the releasable fastener 10 may be used on various other articles that might typically utilize a zipper.

From the foregoing, it will be seen that this subject matter adapted to attain the ends and objects described in this Specification, as well as other advantages which are obvious and which are inherent to the structure. It will be understood that certain features and subcombinations are of utility and may be employed without reference to other features and subcombinations. This is contemplated by and is within the scope of the claims. Since many possible variations and alternatives may be made of this subject matter without departing from the scope thereof, it is to be understood that all matter herein set forth or shown in the accompanying drawings is to be interpreted as illustrative and not in a limiting sense.

The invention claimed is:

1. A releasable fastener comprising:

a first connector and a second connector that are selectively configurable between a connected state and a disconnected state, wherein the second connector slidably inserts into the first connector in the connected state;

the first connector comprising a plurality of connected tubular bodies, wherein each tubular body of the plurality of connected tubular bodies includes a tubular-wall having a tubular-wall first end, a tubular-wall second end, an exterior-facing surface, and an interior-facing surface;

wherein each tubular-wall first end of a respective tubular body and a tubular-wall second end of a respective adjacent tubular body are axially aligned along a length direction of the first connector;

wherein the plurality of connected tubular bodies collectively includes a first-connector first end and a first-connector second end;

wherein the axial alignment of the plurality of connected tubular bodies constructs a continuous partially enclosed receiving channel configured to slidably receive the second connector;

wherein the each tubular body of the plurality of connected tubular bodies includes a respective slot extending entirely from the exterior-facing surface to the interior-facing surface and from the tubular-wall first end to the tubular-wall second end;

wherein each respective slot includes a slot width measured from one side of the respective slot to the other side of the respective slot in a radial direction transverse an axis of the first connector; and the second connector comprising a plurality of connected insert pins, wherein each insert pin of the plurality of connected insert pins and an adjacent insert pin are axially aligned along a length direction of the second connector.

2. The releasable fastener of claim 1, wherein the each tubular body of the plurality of connected tubular bodies is coupled to an edge of a textile body, which connects the plurality of connected tubular bodies to each other.

3. The releasable fastener of claim 2, wherein two or more tubular bodies of the plurality of connected tubular bodies are connected to a common base, which anchors the two or more tubular bodies to the edge of the textile body.

4. The releasable fastener of claim 3, wherein two tubular bodies of the plurality of connected tubular bodies are connected to the common base.

5. The releasable fastener of claim 3, wherein three tubular bodies of the plurality of connected tubular bodies are connected to the common base.

6. The releasable fastener of claim 1, wherein a portion of the insert pin configured to butt against the interior-facing surface of the respective tubular body in the connected state includes a pin abutting surface that is substantially flat in a first two-dimensional plane, wherein the interior-facing surface of the respective tubular body includes a catch surface that is configured to butt against the pin abutting surface in the connected state and that is substantially flat in a second two-dimensional plane.

7. The releasable fastener of claim 6, wherein an article connector extends from the portion of the insert pin.

8. The releasable fastener of claim 6, wherein the respective slot divides the catch surface into a first catch surface and a second catch surface.

9. The releasable fastener of claim 1, further comprising a pin guide coupled to the first-connector second end, the pin guide comprising a curved pin-guide wall forming a partial tube, a pin-guide wall having a concave surface that is coplanar with a portion of the interior-facing surface of the each tubular body of the plurality of connected tubular bodies.

10. The releasable fastener of claim 9, wherein the concave surface extends from a first edge of the pin-guide wall to a second edge of the pin-guide wall, such that a mouth of the pin-guide wall extends between the first edge of the pin-guide wall and the second edge of the pin-guide wall.

11. The releasable fastener of claim 10, wherein the mouth includes a mouth width measured by a shortest distance between the first edge of the pin-guide wall and the second edge of the pin-guide wall, and wherein the mouth width is larger than a pin width.

12. The releasable fastener of claim 9, wherein the pin guide comprises a tube transition wall positioned between the curved pin-guide wall and the first-connector second end, the tube transition wall including an interior surface that gradually increases in surface area as the tube transition wall extends from the curved pin-guide wall to an initial tubular body of the plurality of connected tubular bodies.

13. The releasable fastener of claim 1, wherein the second connector includes a second-connector first end that is inserted into the first-connector second end, and wherein the second connector includes a second-connector second end opposite the second-connector first end.

14. The releasable fastener of claim 13, wherein the second-connector second end includes a stop pin.

15. The releasable fastener of claim 14, wherein the stop pin includes an end cap that abuts and engages a terminal end of the first connector.

16. The releasable fastener of claim 15, wherein the stop pin includes a stop-pin length extending from the end cap to an opposing end of the stop pin, and wherein the stop-pin length is longer than a pin-guide length.

17. The releasable fastener of claim 13, further comprising a pull tab affixed near the second-connector first end.

18. A releasable fastener comprising:

a first connector comprising a plurality of tubular bodies, wherein each tubular body of the plurality of tubular bodies includes a tubular-wall having a tubular-wall first end, a tubular-wall second end, an exterior-facing surface, and an interior-facing surface, wherein each tubular-wall first end of a respective tubular body and a tubular-wall second end of a respective adjacent tubular body are axially aligned along a length direction of the first connector to form a continuous partially enclosed receiving channel; and a second connector comprising a plurality of insert pins, wherein each insert pin of the plurality of insert pins and an adjacent insert pin are axially aligned in a length direction of the second connector, each insert pin of the plurality of insert pins having a respective size and a respective shape configured to slidably move through the continuous partially enclosed receiving channel of the first connector.

19. The releasable fastener of claim 18, wherein the second connector includes a second-connector first end and a second-connector second end, and wherein a pull tab is affixed proximate the second-connector first end.

20. A releasable fastener comprising:

a first connector comprising a plurality of tubular bodies, wherein each tubular body of the plurality of tubular bodies includes a tubular-wall having a tubular-wall first end, a tubular-wall second end, an exterior-facing surface, and an interior-facing surface, wherein each tubular-wall first end of a respective tubular body and a tubular-wall second end of a respective adjacent tubular body are axially aligned in a length direction of the first connector to form a continuous partially enclosed receiving channel; and a second connector comprising a plurality of insert pins, wherein each insert pin of the plurality of insert pins and an adjacent insert pin are axially aligned in a length direction of the second connector, each insert pin of the plurality of insert pins having a respective size and a respective shape configured to slidably move along the pin-guide wall and through the continuous partially enclosed receiving channel of the first connector.

* * * * *